US011266251B2

(12) United States Patent
Pearson

(10) Patent No.: US 11,266,251 B2
(45) Date of Patent: Mar. 8, 2022

(54) ASSISTING DEVICE FOR STANDING TASKS

(71) Applicant: David Pearson, Durham, NC (US)

(72) Inventor: David Pearson, Durham, NC (US)

( * ) Notice: Subject to any disclaimer, the term of this patent is extended or adjusted under 35 U.S.C. 154(b) by 28 days.

(21) Appl. No.: 16/892,808

(22) Filed: Jun. 4, 2020

(65) Prior Publication Data

US 2020/0297123 A1 Sep. 24, 2020

Related U.S. Application Data

(63) Continuation of application No. 15/968,932, filed on May 2, 2018, now Pat. No. 10,716,405.

(51) Int. Cl.
*A47C 16/02* (2006.01)
*A47G 27/02* (2006.01)

(52) U.S. Cl.
CPC ..... *A47C 16/025* (2013.01); *A47G 27/0231* (2013.01)

(58) Field of Classification Search
CPC ..... A47C 16/025; A47G 27/0231
USPC ..... 5/420
See application file for complete search history.

(56) References Cited

U.S. PATENT DOCUMENTS

| | | | | | |
|---|---|---|---|---|---|
| 1,065,022 | A * | 6/1913 | Bell | A47C 9/005 | 248/413 |
| 3,477,673 | A * | 11/1969 | Bereday | A47C 9/025 | 248/121 |
| 3,669,493 | A * | 6/1972 | Vowles | A47C 7/50 | 297/423.11 |
| 4,829,612 | A * | 5/1989 | Adams | A61G 7/1038 | 297/DIG. 10 |
| 5,054,852 | A * | 10/1991 | Tholkes | A61G 5/14 | 297/172 |
| 5,149,174 | A * | 9/1992 | Charash | A47C 9/005 | 248/125.1 |
| 6,926,365 | B2 * | 8/2005 | Bottoms | A47C 9/025 | 182/129 |
| 7,543,341 | B1 * | 6/2009 | Carbaugh | A61G 7/1076 | 5/662 |
| 8,991,554 | B2 * | 3/2015 | Podzimek | A47C 9/005 | 182/132 |
| 9,474,377 | B2 * | 10/2016 | Keen | A47C 7/006 | |
| 10,368,651 | B2 * | 8/2019 | Sitek | A47C 16/04 | |
| 11,051,627 | B2 * | 7/2021 | Faouen | A61G 5/127 | |
| 2002/0089227 | A1 * | 7/2002 | Speraw | A47C 16/04 | 297/423.11 |
| 2020/0237474 | A1 * | 7/2020 | Muller | A47C 7/006 | |

* cited by examiner

*Primary Examiner* — Anita M King
(74) *Attorney, Agent, or Firm* — NCCU IP Clinic; Lorena Gomez; Sean Barlow

(57) ABSTRACT

An assistive device for standing tasks allows for a reduction of effort on the part of a user while engaged in tasks or activities that are stationary or nearly stationary that lessens the strain on the bones, joints, and muscles normally used for standing while ensuring a proper alignment of the pelvis and spine.

4 Claims, 11 Drawing Sheets

ASSISTING DEVICE FOR STANDING TASKS

CROSS-REFERENCE TO RELATED APPLICATION

This application is a Continuation of U.S. application Ser. No. 15/968,932, filed May 2, 2018 (Allowed), and is incorporated by reference in its entirety.

FIELD OF THE INVENTION

The present invention is directed to an assistive device for standing tasks that reduces fatigue associated with tasks or activities that require a user to maintain a stationary or nearly stationary position. More particularly, the invention relates to body supports or leaning devices that transfer a user's weight from one part of his/her body to another. More specifically, the present invention provides a reduction of effort by transferring a user's body weight from the feet alone to the feet and shins.

BACKGROUND OF THE INVENTION

The following description is not an admission that any of the information provided herein is prior art or relevant to the present invention, or that any publication specifically or implicitly referenced is prior art. Any publications cited in this description are incorporated by reference herein. Where a definition or use of a term in an incorporated reference is inconsistent or contrary to the definition of that term provided herein, the definition of that term provided herein applies and the definition of that term in the reference does not apply.

It is well known that certain standing tasks cause strain on a user's body. Thus, a device that can lessen strain on the bones, joints and muscles normally used for standing is especially useful in professions where a person must stand for extended periods of time.

Supportive devices are known which typically include a standing platform and a body-supporting element (see, for example, U.S. Pat. No. 3,477,673). Currently, some supportive devices are designed for a specific task and possess a cumbersome and motion-restrictive design (see, for example, U.S. Pat. Nos. 8,991,554 and 6,926,365). Other devices focus on assisting a user between positions (see, for example, US Publication No. 20020089227). Furthermore, some devices limit a user's reach because they prevent the user's upper body from being in an erect position.

Therefore, there exists a need for an assistive standing device that does not have the aforementioned limitations.

SUMMARY OF THE INVENTION

Therefore, it is an object of the invention to provide assistive device that maximizes the physical comfort of a user as he/she completes tasks that require extended periods of standing.

It is another object of the invention to lessen strain on the bones, joints and muscles normally used for standing while ensuring a proper alignment of the pelvis and spine.

It is another object of the invention to accommodate a myriad of body sized and postures.

It is another object of the invention to encourage subtle movement on the part of the user.

It is another object of the invention to support static posture as well as dynamic posture.

It is another object of the invention to provide a design that that takes up less space for storage, shipping, or travel.

These and other objects of the present invention are achieved in the preferred embodiments disclosed below by providing an assistive device for standing tasks that reduces fatigue by transferring a user's body weight from the feet to the feet and shins. In an exemplary embodiment, a free-standing support device comprises a padded floor panel comprising distal end, medial point, and proximal end; at least two support arms, wherein each support arm has a lower end and an upper end; and a padded knee panel having an upper edge, lower edge and distal surface, and a pivot axis.

In another embodiment, the support arms of the device are fixedly connected to the distal end and the medial point of the floor panel.

In yet another embodiment, the pivot axis is fixedly connected to the upper end of the support arms, and the padded knee panel is fixedly connected to the pivot axis.

In an embodiment, the pivot axis is vertically adjustable.

In another embodiment, the support arms are configured to receive the vertically adjustable pivot axis by a plurality of sequential holes, a plurality of elongated holes, or a tension-reliant single-slot hole.

In yet another embodiment, the upper edge of the knee panel is adjustable to terminate about 1 inch below the tibial tuberosity of a user. In a further embodiment, the knee panel is about 5 inches to about 8 inches high and about 14 inches to about 18 inches wide.

In still another embodiment, the floor panel is adapted to extend in a direction away from a user's toes by about 4 inches to about 6 inches and behind a user's heels by about 8 inches to about 12 inches.

In an alternative embodiment, a free-standing support device comprises a padded floor panel comprising distal end, medial point, and proximal end; at least two support arms, wherein each support arm has a lower end and an upper end; and a padded knee panel having an upper edge, lower edge and distal surface, and a pivot axis. Furthermore, the support arms are fixedly connected to the distal end and the medial point of the floor panel; and wherein the pivot axis is fixedly connected to the upper end of the support arms, and the padded knee panel is fixedly connected to the pivot axis. In an embodiment, the pivot axis is vertically adjustable.

In an embodiment, the support arms are configured to receive the vertically adjustable pivot axis by a plurality of sequential holes, a plurality of elongated holes, or a tension-reliant single-slot hole. In one embodiment, the upper edge of the knee panel is adjustable to terminate about 1 inch below the tibial tuberosity of a user.

In yet another embodiment, the knee panel is about 5 inches to about 8 inches high and about 14 inches to about 18 inches wide. In one embodiment, the floor panel is adapted to extend in a direction away from a user's toes by about 4 inches to about 6 inches and behind a user's heels by about 8 inches to about 12 inches.

In a further embodiment, a free-standing support device comprises a floor panel comprising a floor padding; a support panel comprising a flexible material bent into an arc shape; and a knee panel having a lower edge, upper edge and knee padding. In one embodiment, the upper edge of the knee panel terminates about 1 inches below the tibial tuberosity of a user. And in another embodiment, the knee panel is about 5 inches to about 8 inches high and about 14 inches to about 18 inches wide.

In an embodiment, the floor panel is adapted to extend in a direction away from a user's toes by about 4 inches to about 6 inches and behind a user's heels by about 8 inches to about 12 inches.

In still another embodiment, a free-standing support device for standing tasks comprises floor panel comprising: floor padding, distal end, medial point, and proximal end; at least two support arms, wherein each support arm has a first lower end and first upper end; at least two sliding arms, wherein each sliding arm has a second lower end and second upper end; a pivot axis; a knee panel having a lower edge, upper edge, distal surface and knee padding; a t least sliding posts; at least two support arm pivot posts; a sliding arm end assembly; a horizontal pivot bar; and a handle.

In another embodiment, the first lower ends of the support arms are connected to the pivot posts, wherein the pivot post are fixedly connected to the medial point of the floor panel, and wherein the first upper ends of the support arms are fixedly attached to the horizontal pivot rod. In still another embodiment, the second lower ends of the sliding arms are connected to the sliding posts, wherein the sliding posts are fixedly connected to the distal end of the floor panel;

and the second upper ends of the sliding arms are fixedly attached to the sliding arm end assembly.

BRIEF DESCRIPTION OF THE DRAWINGS

Some of the objects of the invention have been set forth above. Other objects and advantages of the invention will appear as the invention proceeds when taken in conjunction with the following drawings.

DETAILED DESCRIPTION

An assistive standing device is designed and configured to allow for a reduction of effort on the part of a user while the user is engaged in tasks or activities that are stationary or nearly stationary. The assistive standing device achieves this reduction of effort by transferring a user's body weight from the feet (as in "normal" or "unassisted" standing) alone to the feet and shins (i.e., the ventral section of the tibialis anterior muscle and the tibia), wherein the assistive standing device has an efficient design to allow a user greater arm reach to complete a task or activity that requires maintaining foot position.

As used herein, and unless the context dictates otherwise, the terms "free-standing support device," "support device," "assistive device," "assistive standing device," and "assistive device for standing tasks" may be used interchangeably.

As used herein, and unless the context dictates otherwise, the terms "standing" and "static" may be used interchangeably.

As used herein, and unless the context dictates otherwise, the terms "preset holes" and "sequential holes" may be used interchangeably.

Furthermore, as used herein, and unless the context dictates otherwise, the term "user" is intended to include an adult.

As used in the description herein and throughout the claims that follow, the meaning of "a," "an," and "the" includes plural reference unless the context clearly dictates otherwise.

As used herein, the term "about" in conjunction with a numeral refers to a range of that numeral starting from 10% below the absolute of the numeral to 10% above the absolute of the numeral, inclusive.

Furthermore, in another embodiment, the material of construction for the assistive device is steel sheet metal and furthermore is selected based on the usage. For example, in an embodiment, the material can be plywood. Alternatively, in another embodiment, the material can be aluminum. Furthermore, in an embodiment, the material can be plastic. In other embodiments, examples of material of construction include composite or any combination of other materials, including materials with different degrees of flexibility. A skilled person in the art will be readily able to select a suitable material of construction for the assistive standing device based on the operating conditions and requirements in the configurations contemplated herein.

Figure 1:
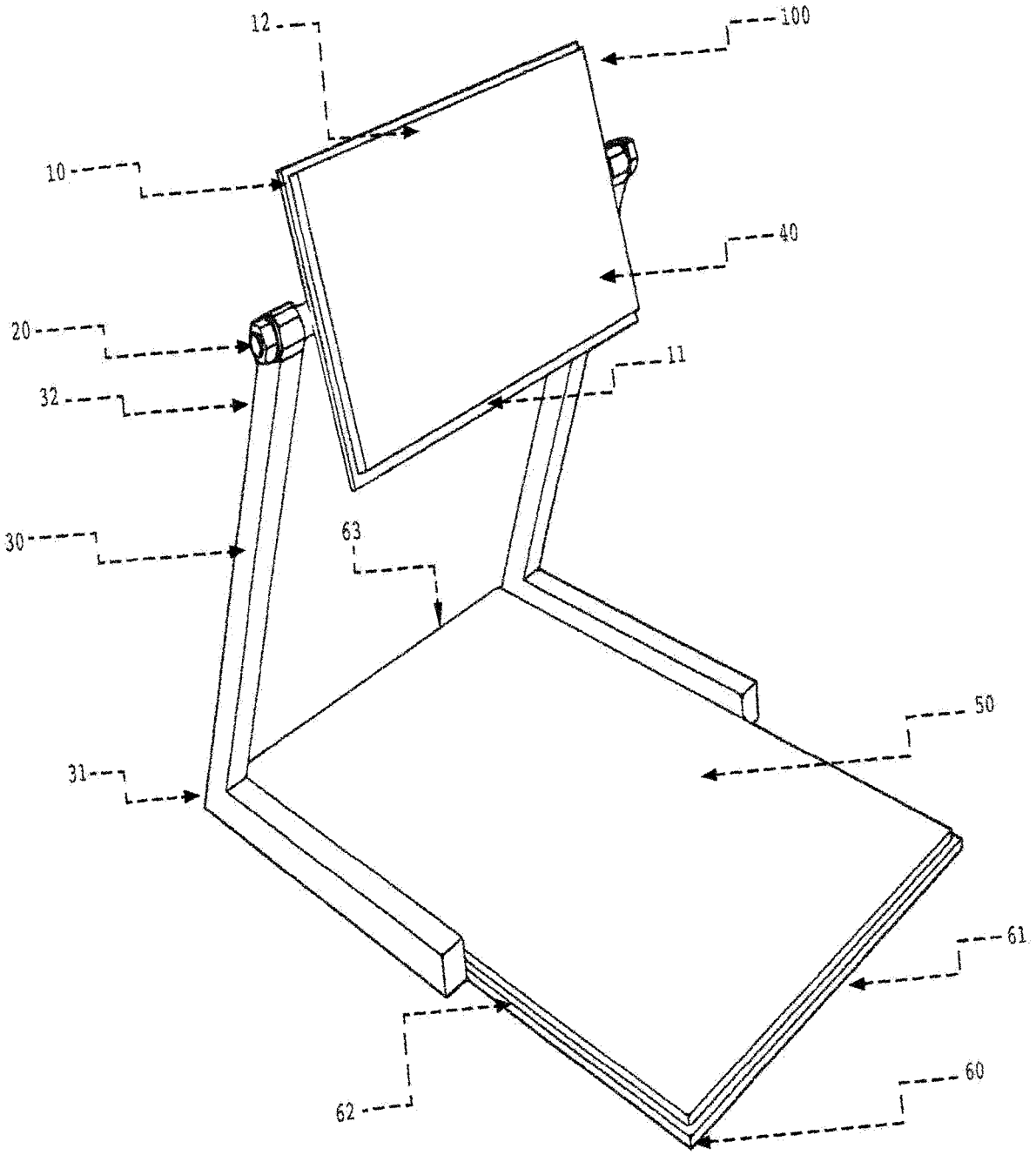
FIG. 1 is an exemplary configuration of an assistive standing device according to the present invention, which depicts a front angle view of the assistive standing device.

An exemplary configuration is schematically depicted in FIG. 1, in which assistive device 100 is designed to reduce the fatigue of a user who must maintain a static position for a long period of time. In one embodiment, assistive device 100 comprises floor panel 60 comprising floor padding 50, distal end 63, medial point 62 and proximal end 61, at least two support arms 30, wherein each support arm includes upper end 32 and lower end 31, pivot axis 20, knee panel 10 having lower edge 11, upper edge 12 and distal surface 43 (see FIG. 3), and fitted with knee padding 40.

Figure 2:
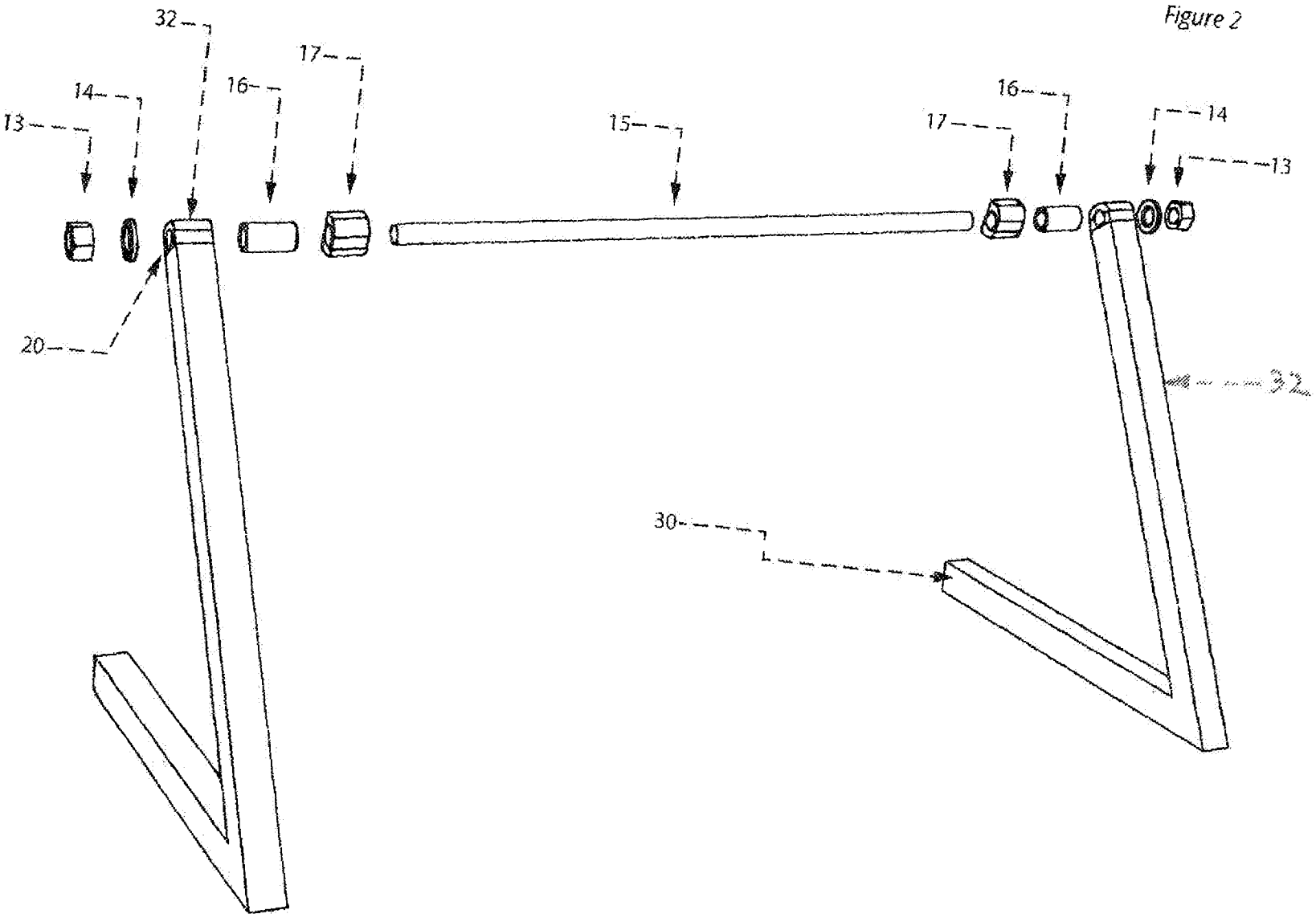
FIG. 2 is an exemplary configuration depicting an exploded view of the support arms and pivot axis assembly of an assistive standing device, according to the present invention.

In an embodiment, as depicted in FIG. 1, assistive device 100 is manufactured from steel sheet metal. In an embodiment, support arms 30 are fixedly connected to distal end 63 and medial point 62 of floor panel 60. In an exemplary embodiment, pivot axis 20 is fixedly attached to support arms 30. As shown in FIG. 2, pivot axis 20 is configured by threading pivot rod 15 through upper ends 32 of support arms 30. In an embodiment, pivot rod 15 is fastened to support arms 30 by plurality of nuts 13, plurality of washers 14, plurality of spacers 16, and plurality of pivot blocks 17. In an embodiment, knee panel 10 (not shown) and knee padding 40 (not shown) are fixedly attached to pivot axis 20 via pivot blocks 17. In an embodiment, knee padding 40 and floor padding 50 are manufactured from a shock absorbent material such as non-toxic EVA foam or anti-fatigue gel foam.

In an exemplary embodiment as shown in FIG. 1, a user engages device 100 at proximal end 61 or medial point 62 and stands on floor panel 60 fitted with padding 50 and engages knee panel 10, by leaning his/her knees and shins between upper edge 12 and lower edge 11 of knee panel 10 fitted with padding 40. In an embodiment, pivot axis 20 is configured to accommodate the posture of the user, whether static or dynamic. Support arms 30 provide extra support for the user's weight. Floor padding 50 and knee padding 40 absorb any shock, reducing fatigue and strain to the user's feet, knees and shins. In one embodiment, support arms 30 are about 1 inch by 1 inch and about 10 to 16 inches tall. In another embodiment, support arms 30 are about 15 inches tall.

Figure 4:
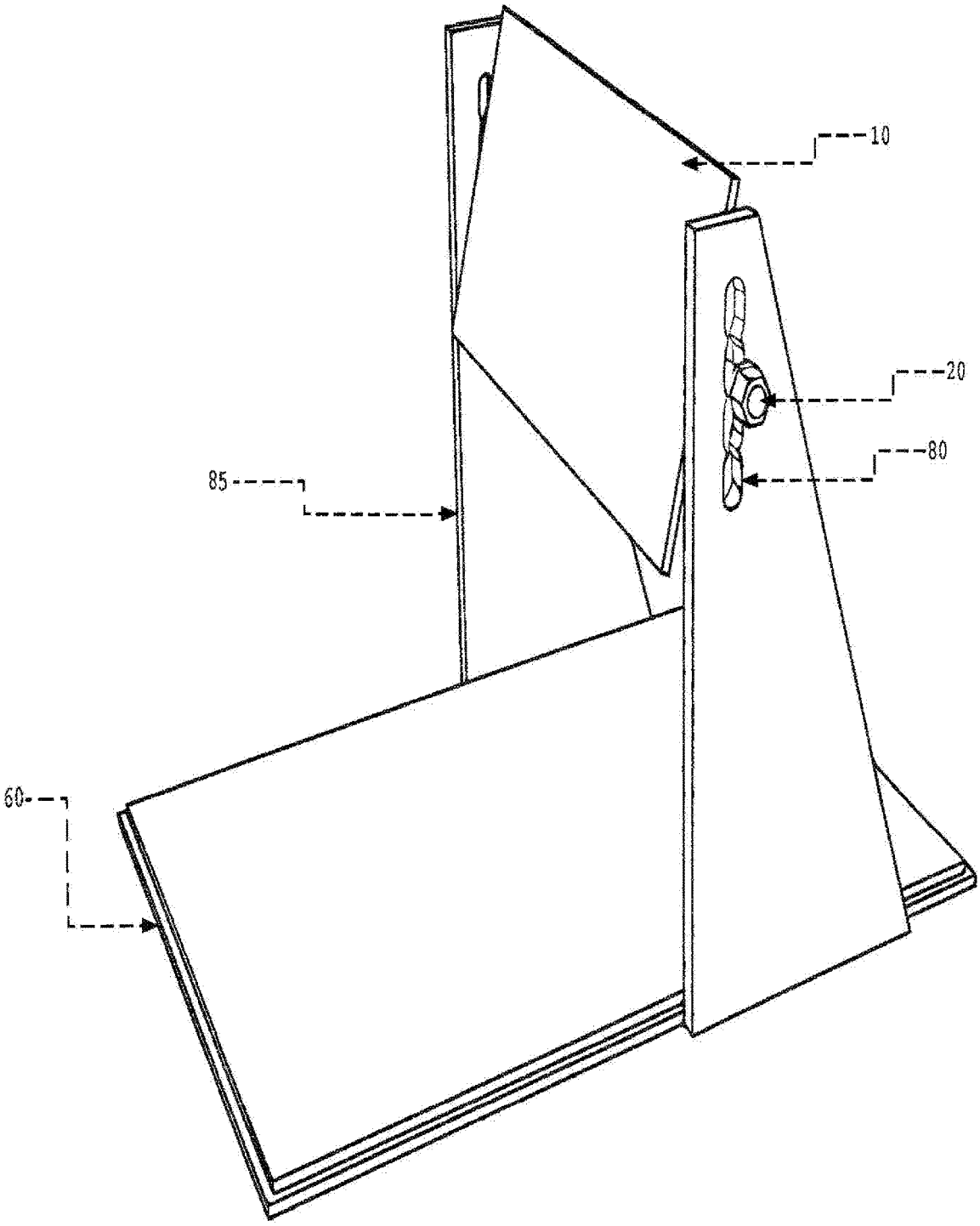
FIG. 4 is an exemplary configuration which depicts a front angle view of the assistive standing device with elongated holes along the support arms and an alternative shape for the support arms, according to the present invention.

In another embodiment, as depicted in FIG. 4, support arms have an alternative shape 85 in which support arms 85 are attached to floor panel 60, and have a series of elongated holes 80 that allow for the height of pivot axis 20 to be adjusted. This embodiment comprises plywood material for support arms 85, knee panel 10, and floor panel 60. In this embodiment, support arms 85 are about 1 to 1.5 inches thick, about 8 inches to about 12 inches wide at the bottom, about 1 inch to about 3 inches wide at the top and about 16 inches to 20 inches tall. In another embodiment, support arms 85 are about 1.5 inches thick, about 10 inches wide at the bottom, about 2 inches wide at the top and about 18 inches tall.

Figure 5:
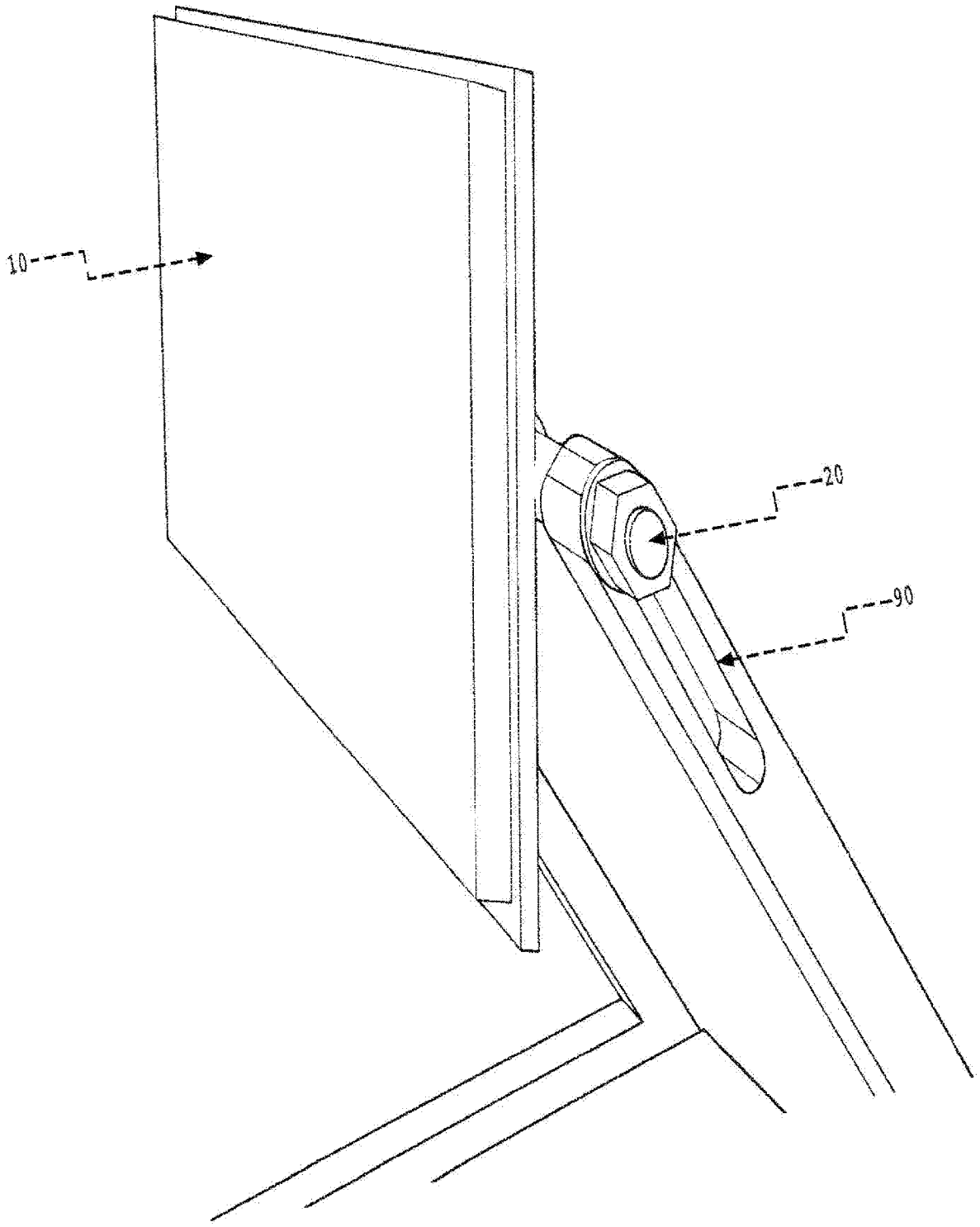
FIG. 5 is an exemplary configuration which depicts a front angle view of the assistive standing device with a tension-reliant elongated hole along the support arms, according to the present invention.

In another embodiment, pivot axis 20 and knee panel 10 are vertically adjustable, and support arms 30 are configured to include a plurality of sequential holes 70 (see FIG. 3), a plurality of elongated holes 80 (see FIG. 4), or a tension-reliant single slot hole 90, as shown in FIG. 5.

Figure 3:
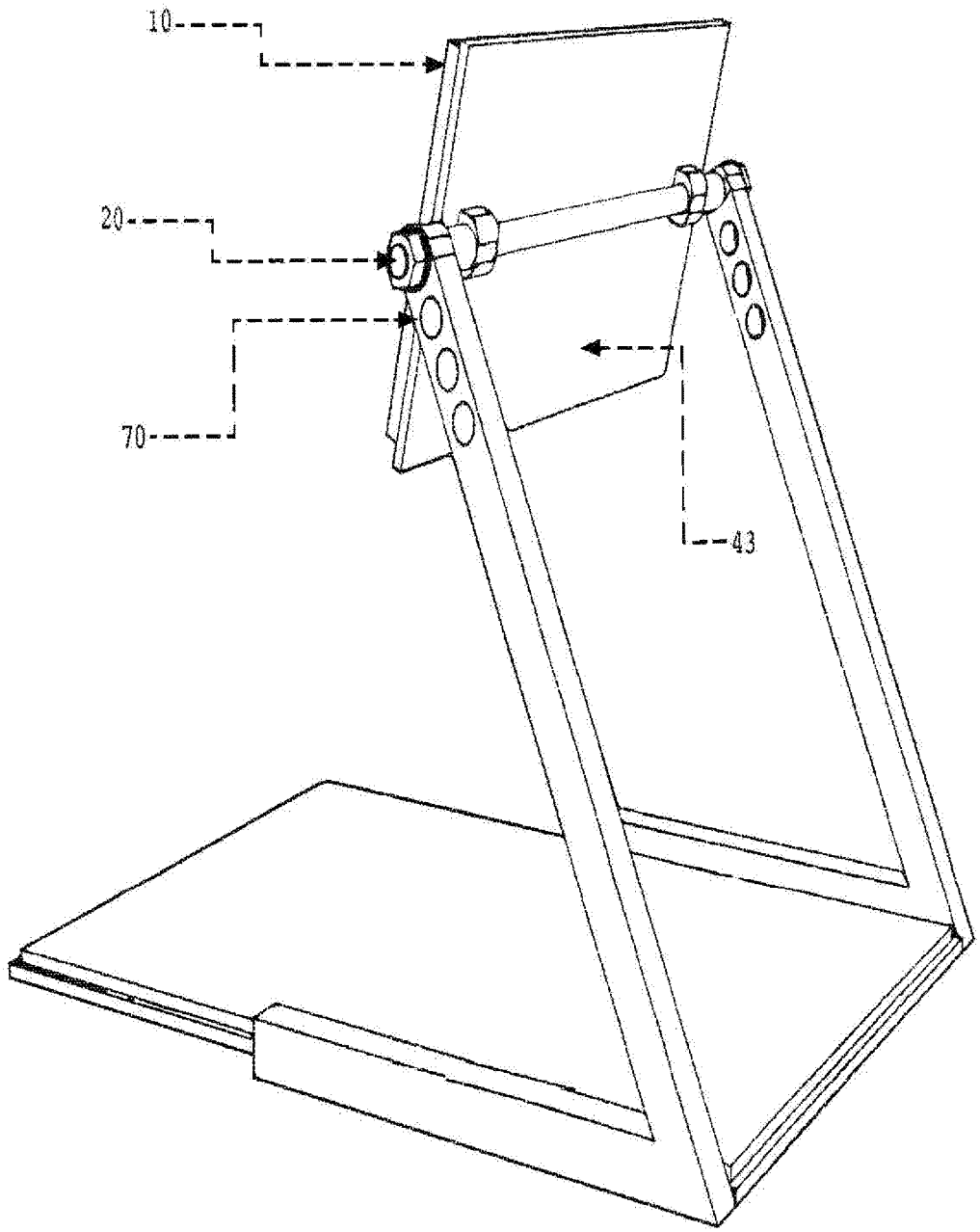
FIG. 3 is an exemplary configuration depicting a front angle view of the assistive standing device with pre-set sequential holes along the support arms, according to the present invention.

In an embodiment as shown in FIG. 3, vertical adjustment of pivot axis 20 and knee panel 10 is accomplished by utilizing preset holes 70. In another embodiment, adjustment of pivot axis 20 and knee panel 10 is accomplished by inserting pivot axis 20 into preset holes 70 in support arms 30. In an exemplary embodiment, to adjust the height in an embodiment with preset holes 70 (see FIG. 3), nut 13 must be removed from each end of pivot axis 20, and pivot axis 20 is disengaged from the ends of pivot axis 20 to allow reinsertion of the pivot axis 20 into preset holes 70 (see FIG. 2). Knee panel 10 is then aligned to a new height along support arms 30 and pivot axis 20 reinserted and nuts 13 refastened.

In another embodiment, adjustment of knee panel 10 and pivot axis 20 is accomplished by utilizing a single slot hole 90 (see FIG. 5). In this embodiment, to adjust the height of knee panel 10 and pivot axis 20, nuts 13 at both ends of pivot axis 20 are loosened to slide knee panel 10 to the desired height along support arms 30, then retightened (see FIG. 2).

In another exemplary embodiment, vertical adjustment of knee panel 10 and pivot axis 20 is accomplished by utilizing elongated holes 80 (see FIG. 4). In this embodiment, to adjust the height of knee panel 10, nut 13 must be removed from one end of pivot axis 20, and pivot axis 20 is then withdrawn horizontally. Knee panel 10 is then aligned to a new height along support arms 85 and pivot axis 20 reinserted and the nut 13 is fastened.

In one embodiment, upper edge 12 of knee panel 10 is adjustable to terminate about 1 inch below the tibial tuberosity of a user.

In one embodiment, knee panel 10 is about 5 inches to 8 inches high and about 14 inches to 18 inches wide. In another embodiment, floor panel 60 is about 14 inches to about inches 18 wide, and about 24 inches to about 30 inches long.

In yet another embodiment, floor panel 60 is adapted to extend in direction away from a user's toes by about 4 inches to about 6 inches and behind a user's heel's by about 8 inches to about 12 inches. In another embodiment, knee padding 40 is attached to knee panel 10 by high strength adhesive, or with mechanical fasteners such as rivets if the knee padding 40 material is resistant to adhesion.

Figure 6:
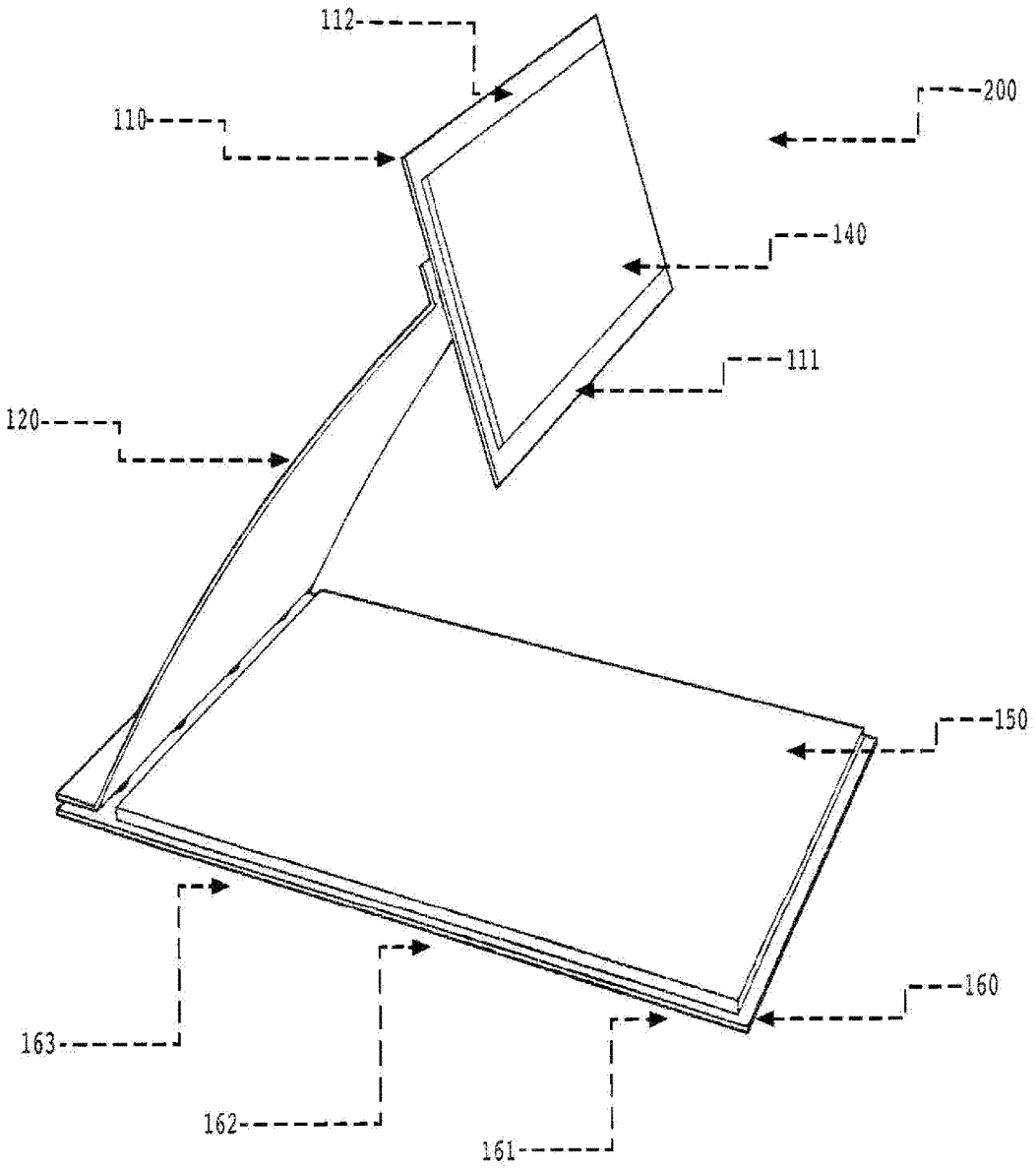
FIG. 6 is an alternative embodiment of an assistive standing device, which depicts a front angle view of the invention.

An alternative configuration is schematically depicted in FIG. 6, in which assistive device 200 is designed to reduce the fatigue of a user who must maintain a static position for a long period of time. In this embodiment, assistive device 200 comprises floor panel 160 with floor padding 150 comprising medial point 162, distal end 163 and proximal end 161, support panel 120, and knee panel 110 having lower edge 111, upper edge 112 and knee padding 140. In one embodiment, support panel 120 comprises a flexible material bent into an arc shape. Flexible material comprises sheet metal, fiber-reinforced plastic, plastic, or any combination thereof. In one embodiment, upper edge 112 of said knee panel terminates about 1 inches below the tibial tuberosity of a user.

In an embodiment, assistive device 200 is manufactured from steel sheet metal. In an embodiment, floor padding 150 and knee padding 140 are manufactured from impact absorbing material such as non-toxic EVA foam or anti-fatigue gel foam.

Figure 7:
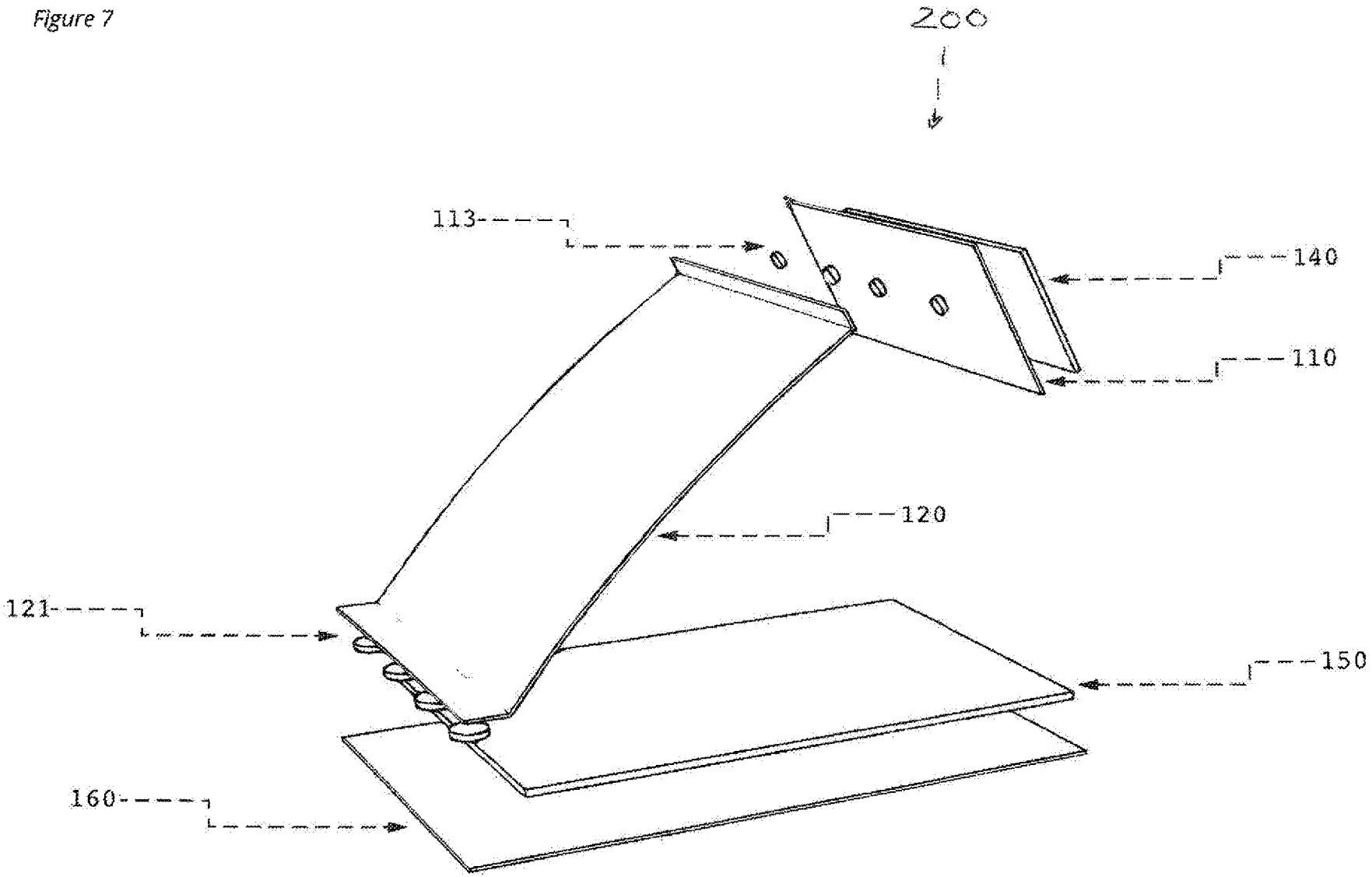
FIG. 7 is an alternative embodiment of an assistive standing device, which depicts an exploded view of the invention.

As shown in FIG. 7, support panel 120 is fixedly attached to floor panel 160 by a first set of rubber washers 121. In one embodiment, rubber washers are attached via either adhesive or a through bolt. In another embodiment, knee panel 110 is fixedly attached to support panel 120 by a second set of rubber washers connected via either adhesive or a through bolt 113 (not shown). In an embodiment, floor panel 160 is fitted with floor padding 150, and knee panel 110 is fitted with knee padding 140.

In one embodiment, a user stands on floor panel 160 fitted with padding 150 at proximal end 161 or medial point 162 (not shown) and engages knee panel 110 fitted with knee padding 140 by leaning the user's knees and shins between upper edge 112 and lower edge 111 of knee panel 110. In another embodiment, support panel 120 is manufactured from flexible material to accommodate the posture of a user, whether static or dynamic, and provide extra support for the user's weight. In an embodiment, flexible material comprises sheet metal, a fiber-reinforced plastic, or plastic. Flexible material is of sufficient strength to support a user, depending on the specific design of the embodiment. In one embodiment, floor padding 150 and knee padding 140 absorb shock, reducing fatigue to the user's feet, knees and shins.

In one embodiment, knee panel 110 is about 5 inches to about 8 inches high and about 14 inches to about 18 inches wide. In another embodiment, floor panel 160 is adapted to extend in a direction away from the user's toes by about 4 inches to about 6 inches and behind a user's heels by about 8 inches to about 12 inches. In an embodiment, support panel 120 is about 1 inches to about 15 inches high and about 12 inches to about 15 inches long. In another embodiment, support panel 120 is about 13 inches high and about 15 inches long.

Figure 8:
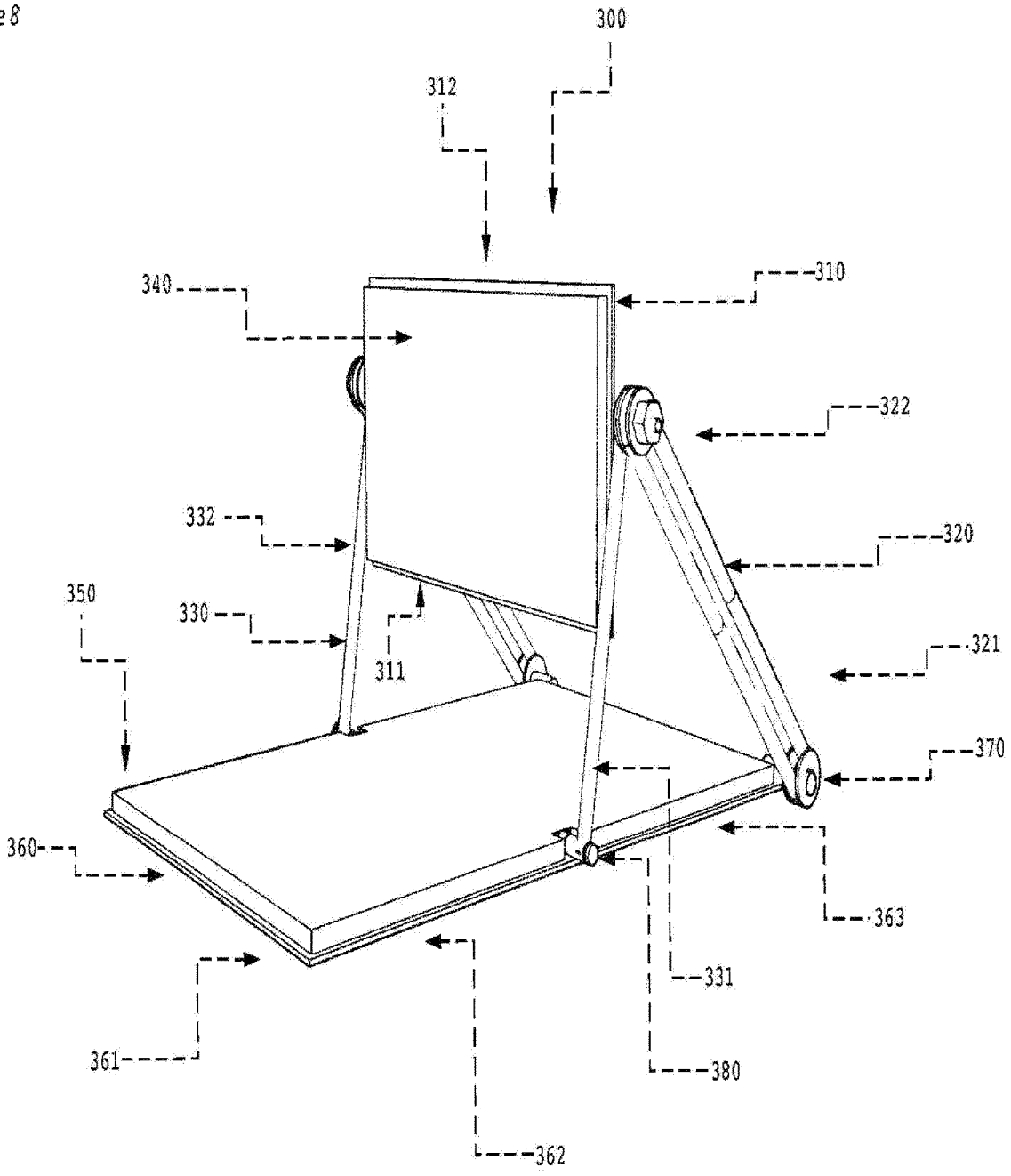
FIG. 8 is an exemplary configuration, which depicts a front angle view of the assistive device with the fold-able mechanism, according to the present invention.
Figure 9:
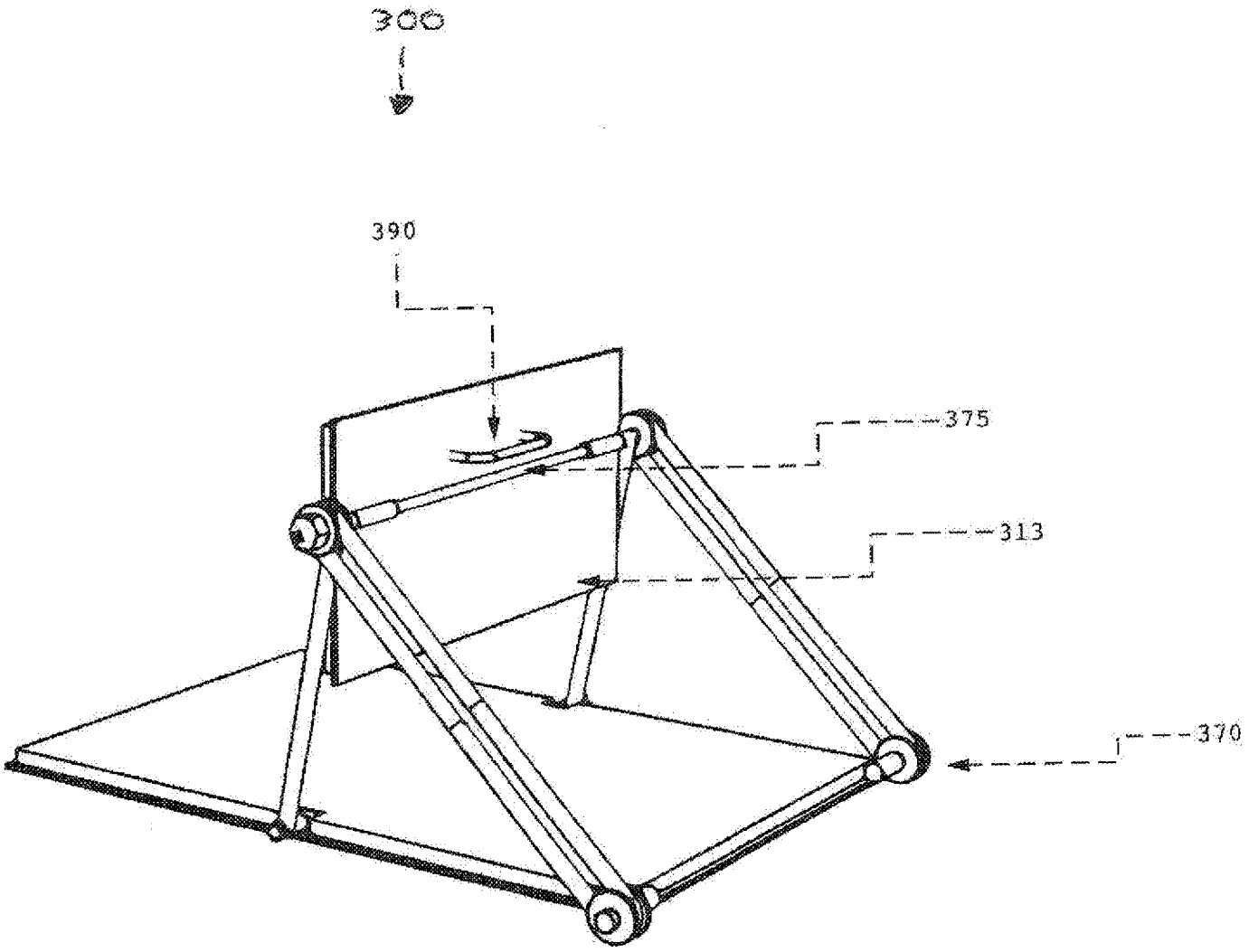
FIG. 9 is an exemplary configuration which depicts a back-angle view of the assistive device with the fold-able support arm mechanism, according to the present invention.
Figure 10:
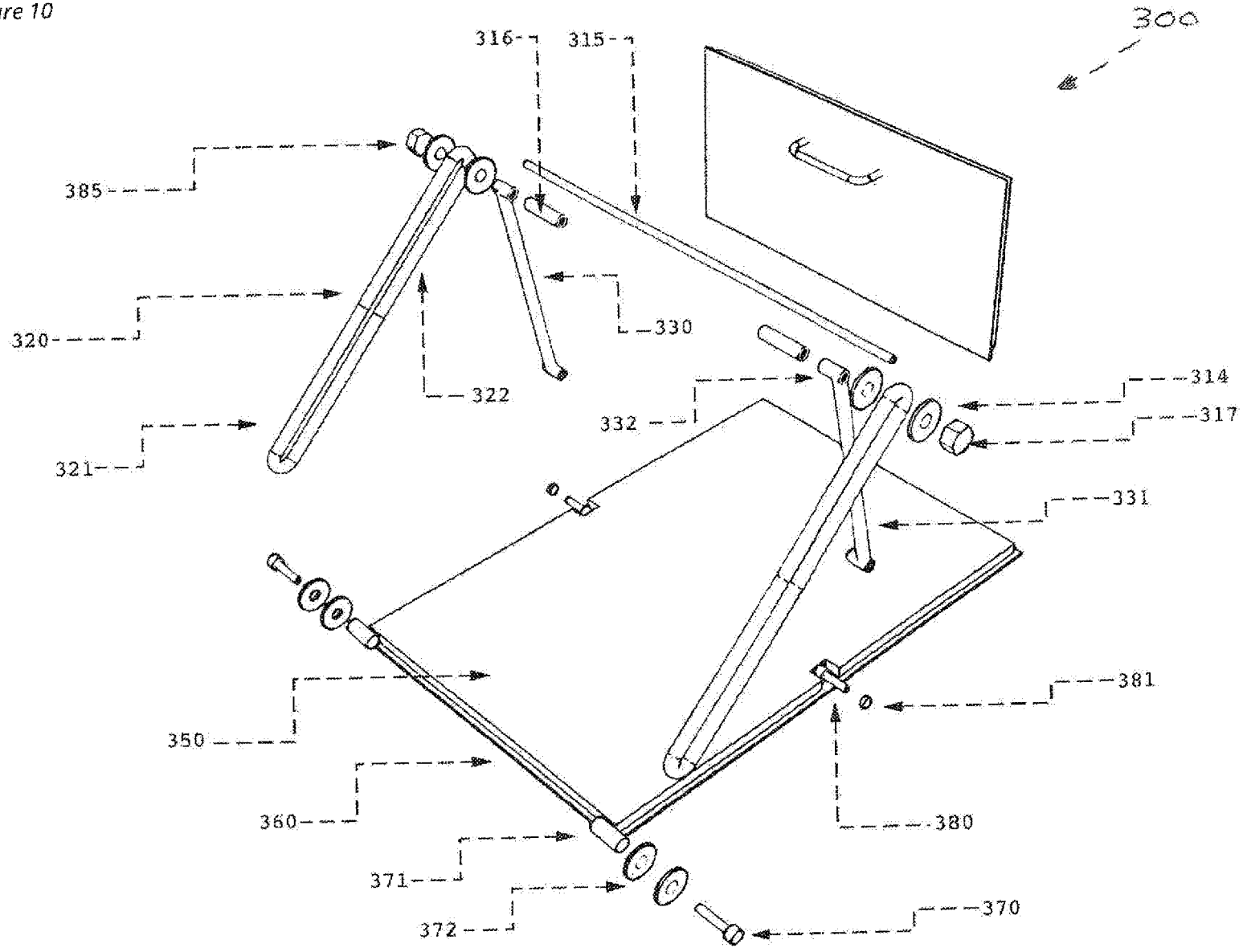
FIG. 10 is an exemplary configuration on an assistive standing device according to the present invention, which depicts an exploded view of the fold-able support arm mechanism.
Figure 11:
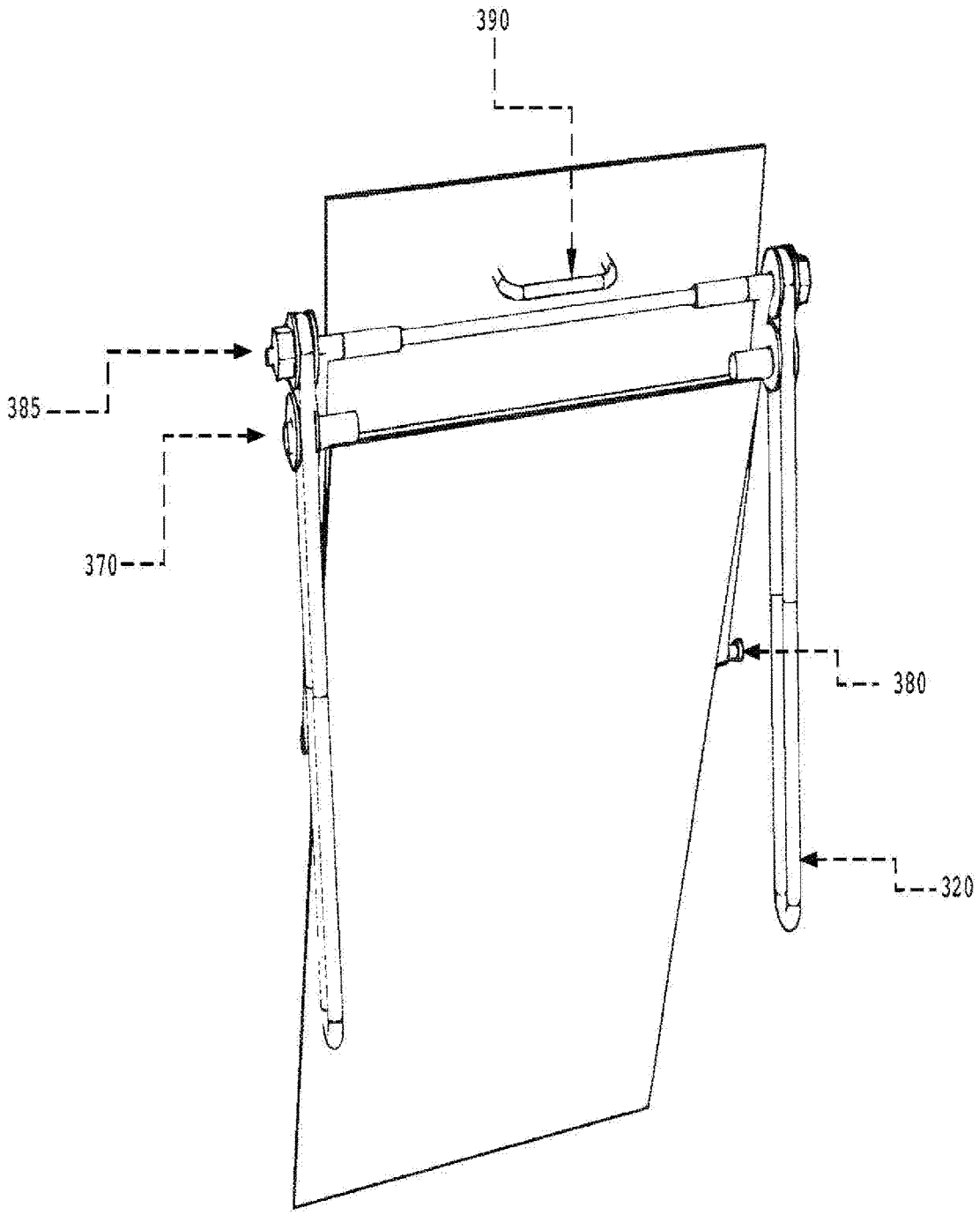
FIG. 11 is an exemplary configuration of an assistive standing device according to the present invention, which depicts the device in a folded position.

Another alternative configuration is schematically depicted in FIGS. 8, 9 and 10, in which assistive device 300 is designed to reduce the fatigue of a user who must maintain a static position for a long period of time. As shown in FIG. 8, assistive device 300 comprises floor panel 360 with floor padding 350 comprising distal end 363, medial point 362 and proximal end 361, at least two support arms 330, each support arm having first upper end 332 and first lower end 331 end, at least two sliding arms 320, each sliding arm 320 having second upper end 322 and second lower 321 end, pivot axis 375 (see FIG. 9), knee panel 310 having a lower edge 311, upper edge 312 and distal surface 313, (see FIG. 9), knee padding 340, at least two sliding posts 370, at least two support arm pivot posts 380, sliding arm end assembly 385, (see FIG. 10) and handle 390, as shown in FIG. 9.

In one embodiment, assistive device 300 is manufactured from steel sheet metal. As shown in FIG. 8, first lower ends 331 of support arms 330 are connected to pivot posts 380, which are fixedly connected to medial point 362 of floor panel 360 via a first set of nuts 381 (see FIG. 10). In another embodiment, first upper ends 332 of support arms 330 are fixedly attached to horizontal pivot rod 315 (see FIG. 10). In yet another embodiment, second lower end 321 of sliding arms 320 are connected to sliding posts 370 which are fixedly connected to distal end 363 of floor panel 360. In another embodiment, second upper ends 322 of sliding arms 320 are fixedly attached to sliding arm end assembly 385.

As shown in FIG. 10, pivot axis 375 (not shown) and sliding arm end assembly 385 are configured by threading pivot rod 315 through upper ends 332 of support arms 330 and upper ends 322 of sliding arms 320. In one embodiment, pivot rod 315 is fastened to support arms 330 and sliding arms 320 by a plurality of a second set of nuts 317, first set of washers 314, and pivot rod sleeves 316. In one embodiment, sliding posts 370 are attached via a plurality of sliding post brackets 371 and second set of washers 372. In one embodiment, knee panel 310 is fitted with padding 340 and fixedly attached to pivot axis 375 via bushings welded to back side of knee panel 310, pivot axis 375 slides through bushings, and has nuts threaded on each end to keep knee panel 310 in place (not shown). In one exemplary embodiment, floor padding 350 is attached to floor panel 360 via contact cement (not shown). Knee padding 340 is attached to knee panel 310 via contact cement or mechanical fasteners along the edges (e.g., rivets) (not shown). In one embodiment, handle 390 is attached to distal end 313 of knee panel 310 via weldment (not shown).

In one embodiment, a user stands on the floor panel 360 fitted with padding 350 at proximal end 361 and engages knee panel 310 fitted with padding 340, by leaning the user's knees and shins between the upper edge 312 and lower edge 311 of knee panel 310 fitted with padding 340. Pivot axis 375 pivots to accommodate the posture of a user, whether static or dynamic. Support arms 330 provide extra support for a user's weight. Floor padding 350 and knee padding 340 absorb shock, reducing fatigue to a user's feet, knees and shins. In one embodiment, sliding arms 320, sliding arm end assembly 385, pivot posts 380, and sliding posts 370 are configured to enable the user to fold assistive device 300. In another embodiment, handle 390 is configured to allow the user to carry assistive device 300.

In yet another embodiment, support arms 330 are about 12 inches to about 16 inches tall. In another embodiment, support arms 330 are about 14 inches tall. In one embodiment sliding arms 320 are about 12 inches to about 18 inches long. In another embodiment, sliding arms 320 are about 16 inches long.

Thus, specific embodiments of an assistive device and methods to employ such device for standing tasks have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A free-standing support device comprising:

(a) a padded floor panel comprising a distal end, medial point, and a proximal end, wherein said padded floor panel is configured to absorb shock and reduce fatigue to a user's feet, knees, and shins;

(b) two support arms attached to said floor panel, wherein said support arms comprise a plurality of elongated holes; and (c) a padded knee panel having an upper edge, lower edge, distal surface, and a pivot axis; and wherein said pivot axis and said knee panel are vertically adjustable.

2. The free-standing support device of claim 1, wherein said support arms, said knee panel, and said floor panel comprise plywood.

3. The free-standing support device of claim 1, wherein the bottom of said support arms are wider than the top of said support arms.

4. The free-standing support device of claim 1, wherein said support arms are about 1.5 inches thick, about 10 inches wide at the bottom, about 2 inches wide at the top and about 18 inches tall.

* * * * *